US008448274B2

(12) United States Patent
Broens

(10) Patent No.: US 8,448,274 B2
(45) Date of Patent: May 28, 2013

(54) LEG SUPPORT INSTRUMENT AND SUPPORTING METHOD

(75) Inventor: Paulus Maria Antonius Broens, Groningen (NL)

(73) Assignee: Academisch Ziekenhuis Groningen, Groningen (NL)

( * ) Notice: Subject to any disclaimer, the term of this patent is extended or adjusted under 35 U.S.C. 154(b) by 332 days.

(21) Appl. No.: 12/936,574

(22) PCT Filed: Apr. 7, 2009

(86) PCT No.: PCT/NL2009/050180

§ 371 (c)(1),
(2), (4) Date: Jan. 7, 2011

(87) PCT Pub. No.: WO2009/126032

PCT Pub. Date: Oct. 15, 2009

(65) Prior Publication Data

US 2011/0185506 A1 Aug. 4, 2011

(30) Foreign Application Priority Data

Apr. 8, 2008 (NL) ..... 2001456

(51) Int. Cl.
*A61G 7/075* (2006.01)
*A61G 13/12* (2006.01)

(52) U.S. Cl.
USPC ..... 5/648; 5/624; 5/905

(58) Field of Classification Search
USPC 5/648–651, 624, 621–623, 602, 905; 602/32, 602/33, 36, 39, 40; 128/845
See application file for complete search history.

(56) References Cited

U.S. PATENT DOCUMENTS 5,560,577 A * 10/1996 Keselman ..... 248/279.1
5,582,379 A * 12/1996 Keselman et al. ..... 248/279.1
5,802,641 A * 9/1998 Van Steenburg ..... 5/648
5,918,330 A * 7/1999 Navarro et al. ..... 5/624
5,961,085 A * 10/1999 Navarro et al. ..... 248/279.1
6,058,534 A 5/2000 Navarro et al.
6,263,531 B1 * 7/2001 Navarro et al. ..... 5/648
6,629,944 B2 * 10/2003 Smart ..... 602/36
6,704,959 B2 * 3/2004 Schuerch ..... 5/648
7,243,654 B2 * 7/2007 Schuerch ..... 128/845
RE41,412 E * 7/2010 Van Steenburg ..... 5/648
2002/0128577 A1 9/2002 Smart
2003/0028967 A1 * 2/2003 Schuerch ..... 5/621
2006/0225743 A1 * 10/2006 Schuerch ..... 128/845
2011/0185506 A1 * 8/2011 Broens ..... 5/648

* cited by examiner

OTHER PUBLICATIONS

Ong, Hong Djien, "International Search Report", International Application No. PCT/NL2009/050180, mailed on Jul. 22, 2009 (2 pages).

*Primary Examiner* — Robert G Santos
(74) *Attorney, Agent, or Firm* — Fish & Richardson P.C.

(57) ABSTRACT

A leg support instrument is designed to be fastened, in a table fastening condition, to a longitudinal side of an operating table. The instrument comprises a first frame part provided with fastening means having a table engaging portion. The instrument also comprises a second frame part with adjustable support means fastened thereto for supporting a lower leg of a person. A first hinge having a first axis of rotation connects the first frame part to the second frame part. In the table fastening condition, different distances can be set between the table engaging portion and the first axis of rotation. The instrument comprises aligning means for aligning a position of the first axis of rotation depending on a position of a person lying on the operating table. The aligning means are designed for projecting a light beam extending in line with the first axis of rotation on the lying person.

7 Claims, 9 Drawing Sheets

LEG SUPPORT INSTRUMENT AND SUPPORTING METHOD

CROSS-REFERENCE TO RELATED APPLICATIONS

This application is the National Stage of International Application No. PCT/NL2009/050180, filed Apr. 7, 2009, which claims priority to Netherlands Application No. 2001456, filed Apr. 8, 2008. The contents of these applications are hereby incorporated by reference in their entireties.

TECHNICAL FIELD

The invention relates to a leg support instrument according to the preamble of claim 1. The invention also relates to a method for supporting at least one lower leg of a person lying on an operating table with the aid of at least one such instrument.

BACKGROUND

Such leg support instruments are known from practice and are utilized for stably securing both legs of a person with set abduction for the purpose of examination or surgery on anus, perineum, scrotum, penis or vagina. Here, as a rule, to one longitudinal side of the operating table, a first such instrument is fastened and to the other longitudinal side a second such instrument is fastened. One lower leg of an adult person lying on his back on the operating table is supported by one thus fastened instrument and the other lower leg by the other thus fastened instrument.

As a rule, during such examinations or surgery, it is necessary to change the position of the legs several times with respect to the upper part of the body of the person. Such changes in position, where, if required, also the extent of flexion of the legs is to be changed, can be achieved by mutually hinging the first frame part and the second frame part about the first axis of rotation. During such changes of position, great forces are exerted on the hip joint.

A drawback of the known leg support instruments is that these great forces mentioned can cause damage to the hip joint, while the hip joint may even be dislocated. In general, with adults, the risk of dislocation of the hips is not very great as the hip joint of an adult is relatively robust. However, with small children, including babies, this risk is relatively great. Partly because of this reason, the known leg support instruments are less suitable for use with small children. With babies and other small children, instead of utilizing such leg support instruments, the feet of the children are secured on the operating table with tape. This latter situation is undesired, also because it limits the possibilities of changing the position of the legs.

It is noted that FIG. 10 of US 2002128577A1 shows a leg support instrument according to the preamble of claim 1. It is further noted that U.S. Pat. No. 6,058,534A shows a leg support instrument in which some of the features of the preamble of claim 1 are utilized, however, not the feature that the instrument is adjustable in the sense that, in the table fastening condition, different distances can be set between the table portion and the first axis of rotation of the first hinge.

SUMMARY

The disclosure provides an efficient solution according to which, for persons of different size lying on their back on an operating table, the legs can be supported while changes of position of the legs can be realized while exerting limited forces on the hip joint.

To this end, a leg support instrument according to claim 1 is provided.

Owing to the adjustability mentioned, in the table fastening condition, a height position of the first axis of rotation can be aligned with respect to the lying surface of the operating table, depending on the dimensions and the position of a person thus lying on the operating table. This height position can be aligned such that the fictitious lengthening of the first axis of rotation intersects the hip joint at a location such that, upon the mutual hinging of the first frame part and the second frame part about the first axis of rotation, the forces on the hip joint are limited.

The instrument comprises aligning means for aligning, in the table fastening condition, a position of the first axis of rotation depending on a position of a person thus lying on the operating table. Such aligning means promote the efficiency and accuracy of the adjustment of the instrument.

Preferably, upon setting the instrument, the position of the first axis of rotation is aligned such that the first axis of rotation substantially coincides with the transversal axis of rotation of the hip joint of the person lying on the operating table. This transversal axis of rotation is located, viewed in the direction of the head of the person, somewhat beyond the large bone bulge of the upper leg (also called "Trochanter Major Femori"). It has appeared that with such a position of the first axis of rotation, the forces on the hip joint are very limited during the relative hinging movement of the first and the second frame part about the first axis of rotation.

The aligning means are designed to project a light beam extending in line with the first axis of rotation on the person thus lying on the operating table. The use of a light beam offers the advantage that the light beam itself is as straight as an arrow and therefore highly accurate and takes up no space. The light beam can also automatically extend as far as the body of the respective person, irrespective of the dimensions and the position of this person. The aligning means can for instance comprise a light channel in the instrument extending in line with the first axis of rotation. Here, the light source of the light beam can for instance be formed in that a user shines a flashlight in the light channel in the direction of the person lying on the operating table. But the light source can also be a light source built-in in the instrument.

In a preferred embodiment, the adjustable support means are fastened to the second frame part by means of a second ball joint, and the adjustable support means comprise an adjusting part, which adjusting part comprises an elongated part which is adjustable in that the elongated part is slideable in its longitudinal direction relative to the second ball joint and is rotatable about a second axis of rotation formed by its longitudinal direction. As a result, the instrument has very many adjusting possibilities, so that legs of persons of different dimensions can be secured in various desired positions.

Preferably, the adjustable support means comprise lower leg engaging means which are designed for retaining a lower leg of a person thus lying on the operating table in the lower leg retaining condition, while the lower leg engaging means are fastened to the adjusting part by means of a third ball joint. This further favourably influences the adjusting possibilities of the instrument.

More preferably, the third ball joint is adjustable in that the third ball joint is rotatable about a third axis of rotation, which third axis of rotation has at least one component that is transverse to the longitudinal direction of the elongated part. This further favourably influences the adjustment possibilities of the instrument.

Some embodiments include an assembly of two separate instruments according to one of the above-mentioned embodiments, wherein one instrument is designed to be fastened, in the table fastening condition, to one longitudinal side of the operating table for supporting one lower leg of a person thus lying on the operating table and the other instrument is designed to be fastened, in the table fastening condition, to the other longitudinal side, opposite the longitudinal side mentioned of the operating table for supporting the other lower leg of the person.

In the following, embodiments are described in further detail with reference to the schematic Figures in the appended drawing.

DETAILED DESCRIPTION

Figure 1:
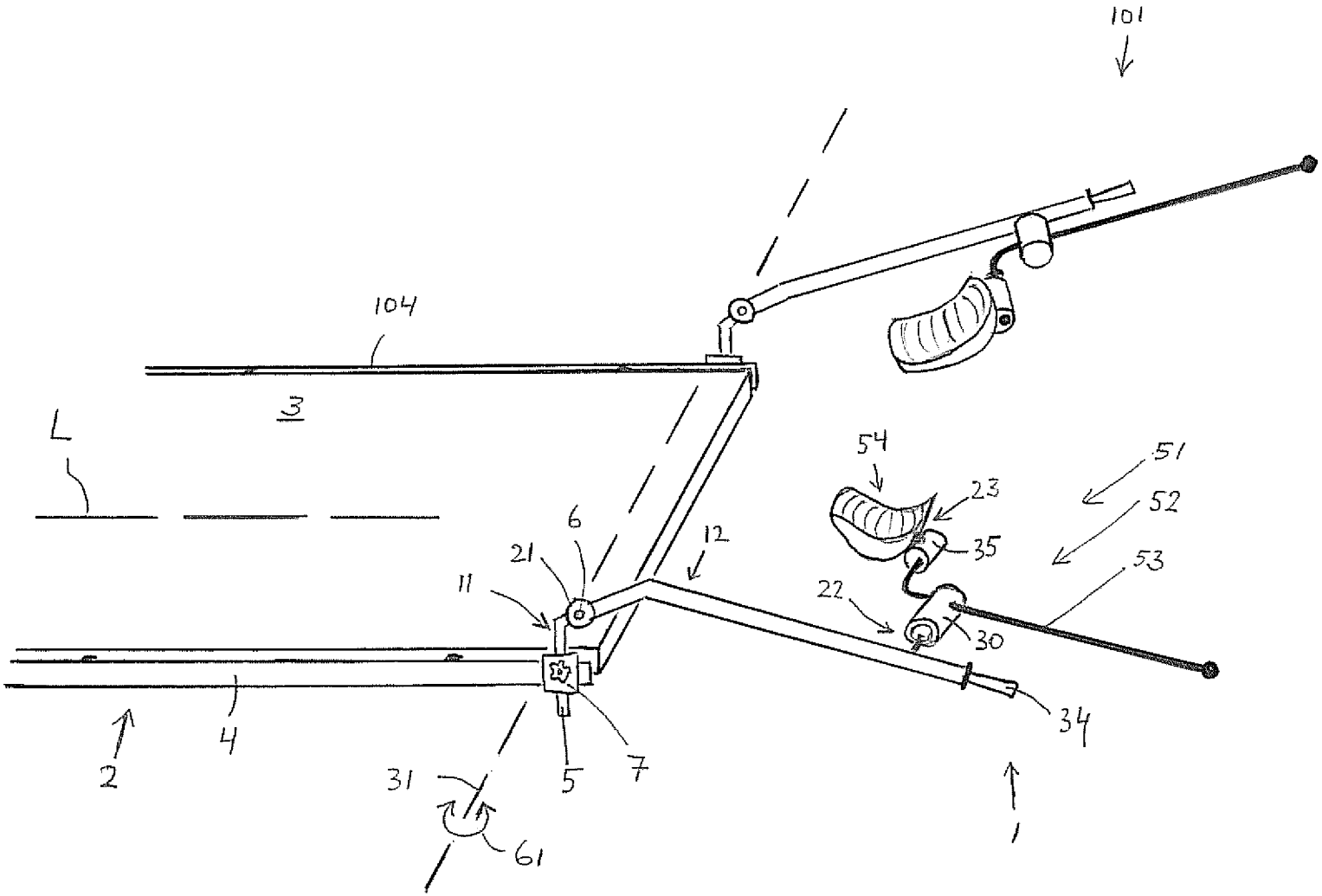
FIG. 1 shows, in perspective, an example of an embodiment of a leg support instrument according to the invention in a table fastening condition.
Figure 8:
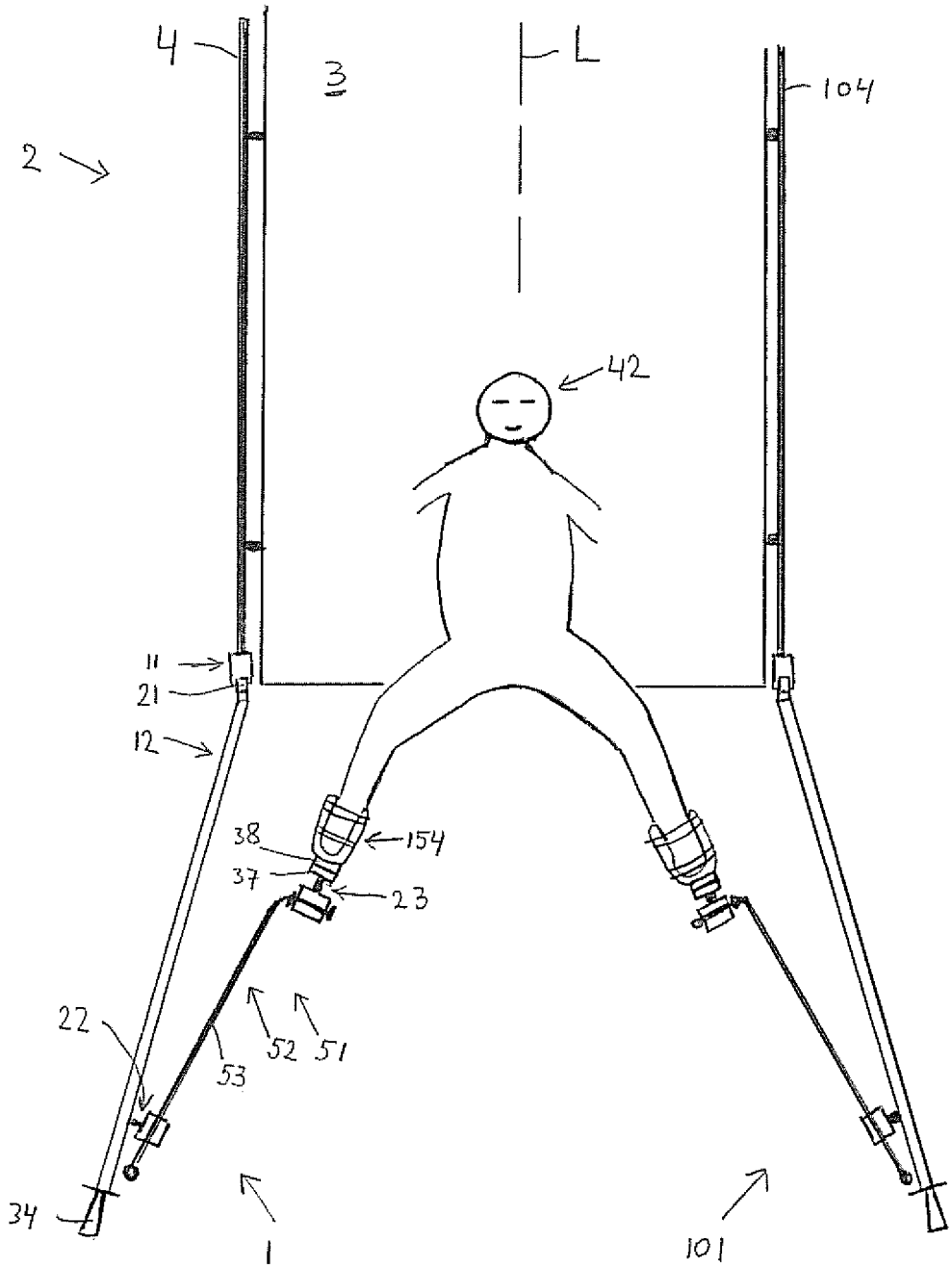
FIG. 8 shows, in top plan view, the example of FIG. 1 in a condition in which the instrument engages a lower leg of a relatively small person.
Figure 9:
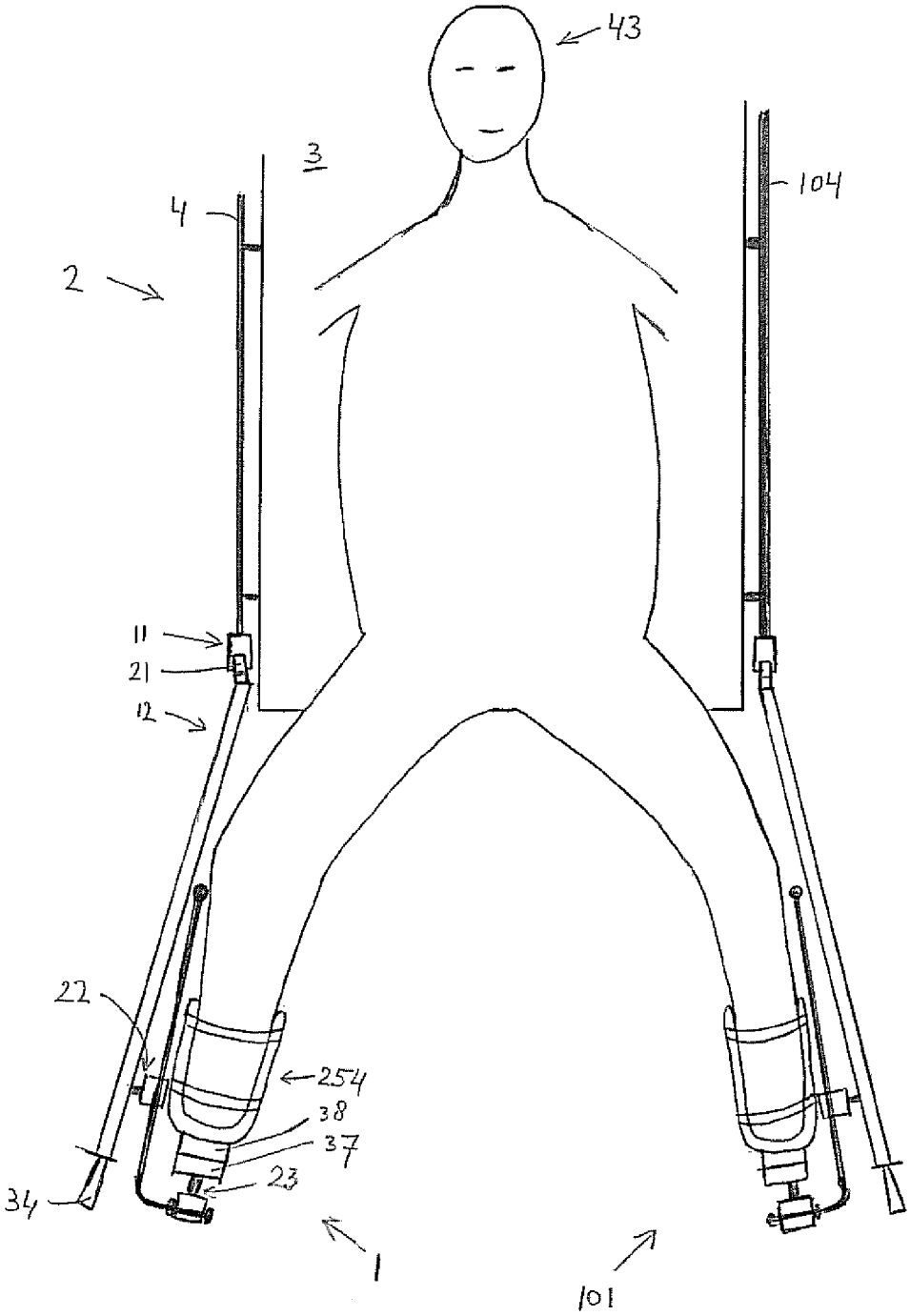
FIG. 9 shows, in top plan view, the example of FIG. 1 in a condition in which the instrument engages a lower leg of a relatively large person.

In FIGS. 1, 8 and 9, a part of an operating table 2 is shown, which operating table is provided with a lying surface 3 having a lying surface longitudinal direction L. The operating table 2 has two opposite longitudinal sides 4 and 104. The longitudinal sides 4 and 104 are of the strip-shaped type customary with operating tables, with the strip height extending in transverse direction to the lying surface 3 and the strip length extending in the lying surface longitudinal direction L.

The FIGS. 1-8 show (parts of) a leg support instrument 1 which is detachably securable to the longitudinal side 4 of the operating table 2. In FIGS. 1, 2, 8 and 9, in a table fastening condition, the leg support instrument 1 is shown fastened to the longitudinal side 4, while in these Figures, a similar leg support instrument 101 is shown in a similar table fastening condition on the opposite longitudinal side 104.

The two separate instruments 1 and 101 form an assembly, wherein, in FIGS. 8 and 9, in the table fastening condition, one instrument 1 supports one lower leg of a person 42, 43, respectively, lying on his back on the lying surface 3 of the operating table 2, and the other instrument 101 supports the other lower leg of the person thus lying on the operating table.

Figure 3:
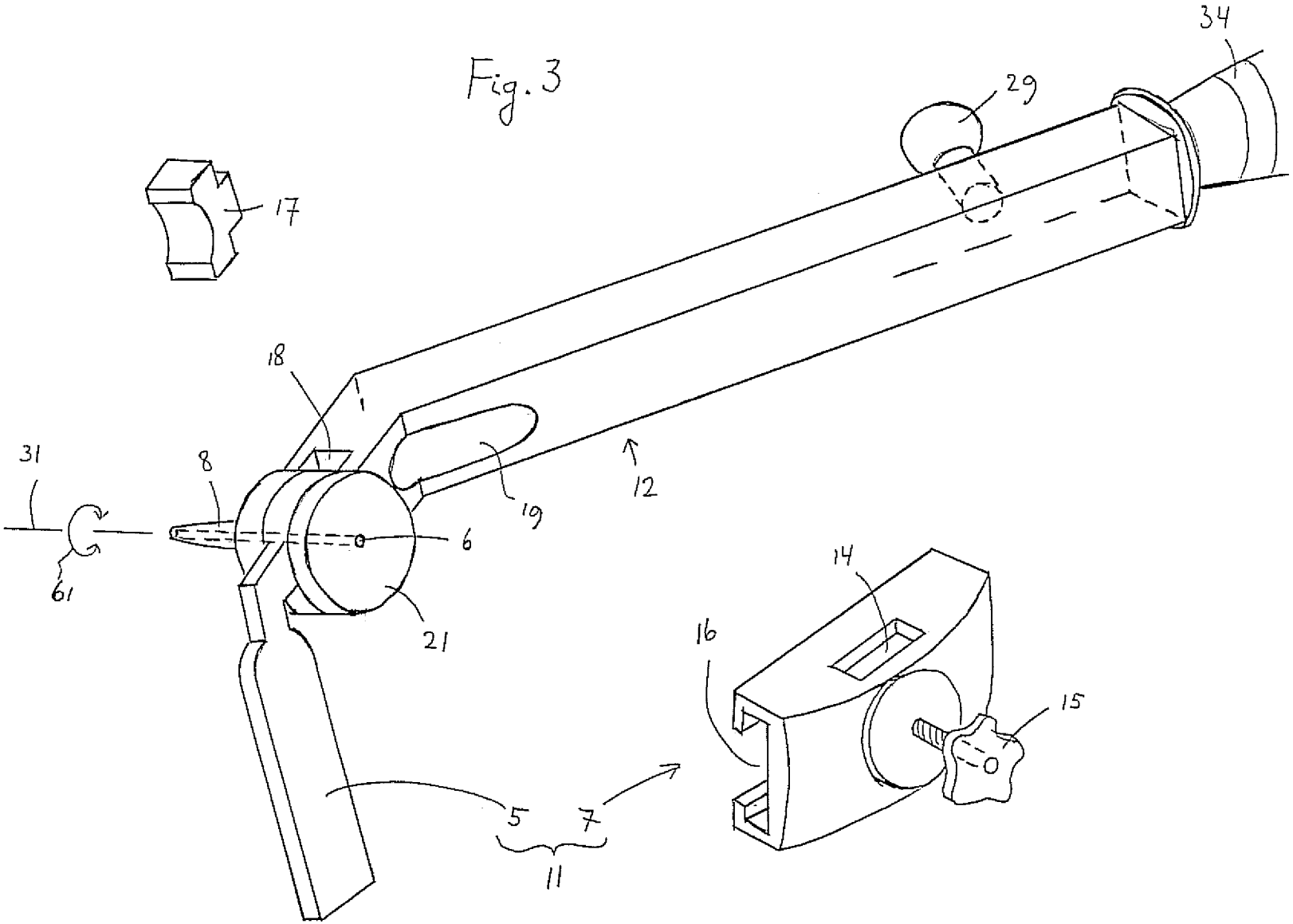
FIG. 3 shows, in perspective, a part of the example of FIG. 1 in partly disassembled condition.

The leg support instrument 1 comprises a first frame part 11 which comprises an elongated sliding part 5, see in particular FIG. 3. The first frame part 11 is further provided with fastening means. The fastening means comprise a table engaging portion 7 for engaging, in the table fastening condition, the longitudinal side 4 of the operating table 2 in a fastening manner. Thereto, the table engaging portion 7 has a slot 16 (see FIG. 3) with which the table engaging portion 7 can be slid in the lying surface longitudinal direction L over the strip-shaped longitudinal side 4, and two passages 14 (in FIG. 3, only the upper passage 14 is shown) for receiving therein, in a slideable manner, the sliding part 5. When the table engaging portion 7 has been slid over the longitudinal side 4 of the operating table 2, and the sliding part 5 has slid into the table engaging portion 7, by tightening an operating screw 15 of the table engaging portion 7, the sliding part 5 is clamped against the longitudinal side 4 such that the instrument 1 engages the longitudinal side 4 in a fastening manner. In the example shown, this securing engagement can take place in various mutually continuously variable sliding positions of the sliding part 5 with respect to the table engaging portion 7.

Figure 2:
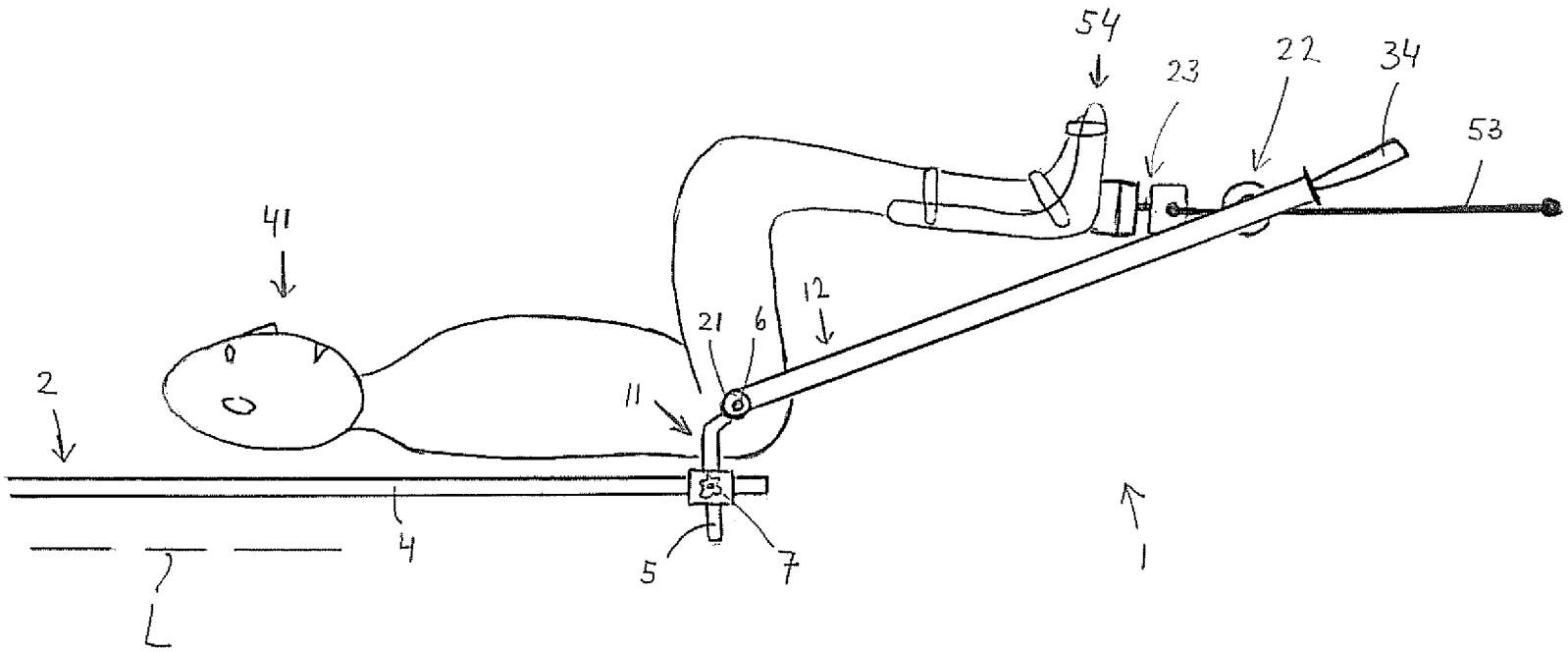
FIG. 2 shows the example of FIG. 1 in side view.

The leg support instrument 7 further comprises a second frame part 12 with adjustable support means 51 fastened thereto for supporting, in the table fastening condition, in a lower leg engaging condition, a lower leg of a person lying on his back on the lying surface of the operating table. This person is indicated in FIGS. 2, 8 and 9 with respective reference numeral 41, 42 and 43. In the example shown, the second frame part 12 is hollow and tubular with a rectangular cross section. In its longitudinal direction, the second frame part 12 has a bend where the wall of the second frame part 12 has an opening 19, see FIG. 3.

The leg support instrument 1 further comprises a first hinge 21 connecting the first frame part 11 and the second frame part 12 in a hinging manner. The first hinge 21 has a first axis of rotation 31 which, in the table fastening condition, extends parallel to the lying surface 3 and transversely to the lying surface longitudinal direction L. The relative hinging movement of the first and the second frame part about the first axis of rotation 31 is indicated in FIGS. 1 and 3 with a double arrow 61.

Figure 4:
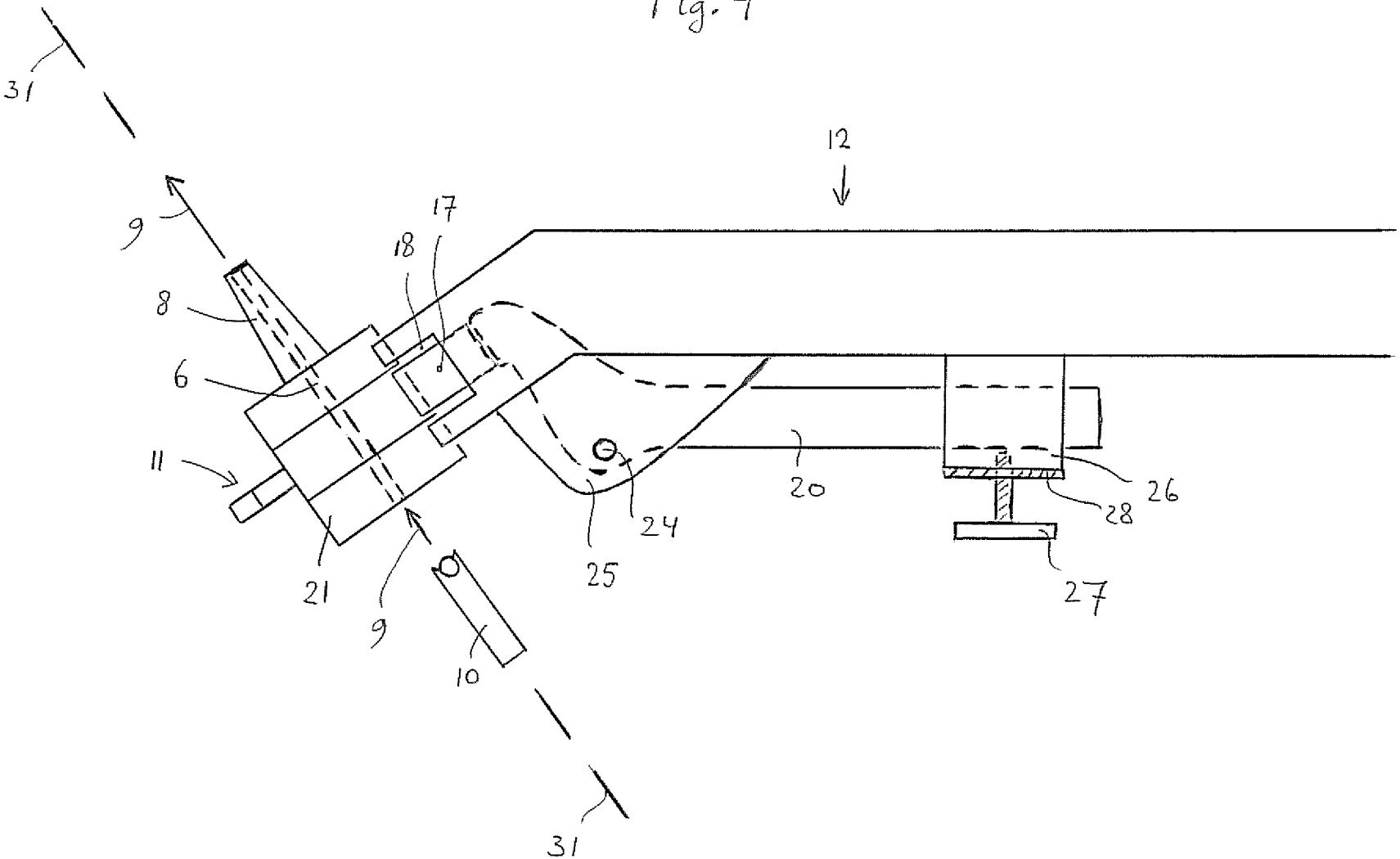
FIG. 4 shows a part of the example of FIG. 1 in top plan view.
Figure 5:
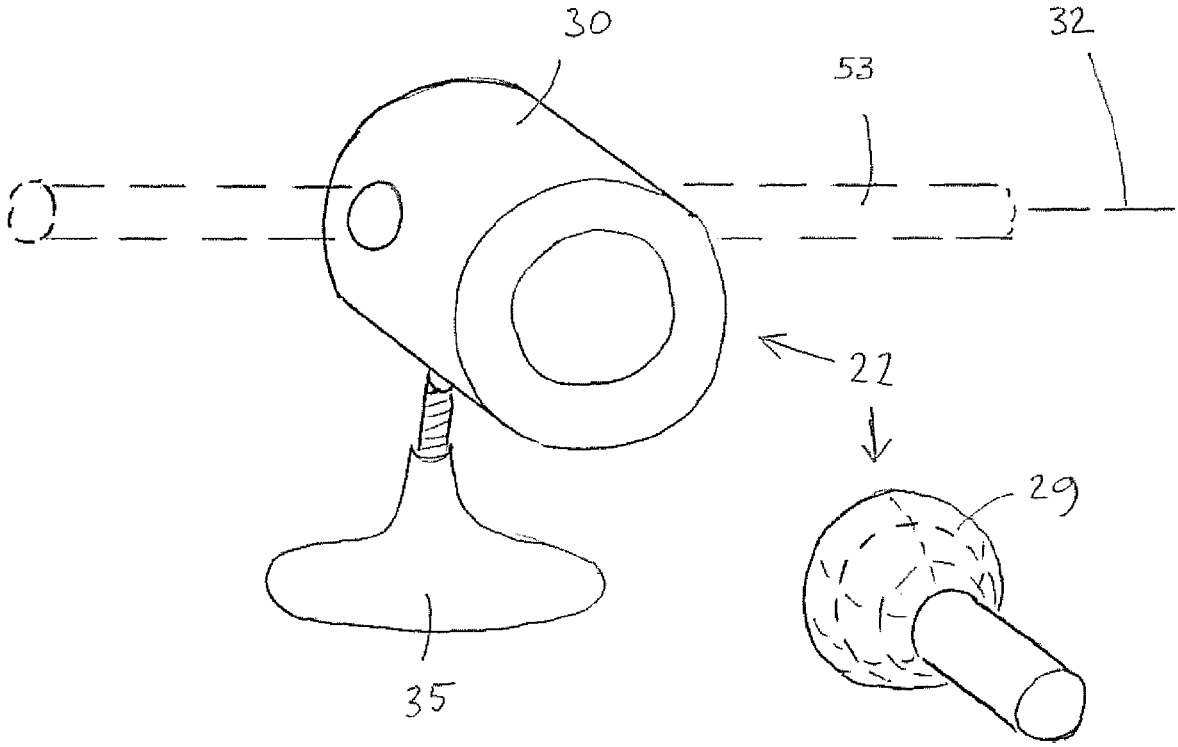
FIG. 5 shows, in perspective, an example of an element with ball joint utilized in a leg support instrument according to the invention.

In the example shown, the instrument is provided with an operation mechanism for mutually adjusting the first and the second frame part about the first pivot 31 in a continuously variable manner, between different relatively non-movable, fixed rotational positions. FIG. 3 and in particular FIG. 4 show a few parts of this operating mechanism. However, for the sake of simplicity of presentation, this operating mechanism has been omitted in the other Figures. FIG. 3 shows a break block 17 which, in operation, is placed in the interior of the second frame part 12 at the location of the opening 18 shown in FIGS. 3 and 4 in a wall of the second frame part 12. FIG. 4 shows that the second frame part 12 is provided with a few appendages, such as two parallel plate parts 25 (only the upper one of these two plate parts is shown) which are connected by a pivot 24 extending transversely to these plate parts, two parallel plate parts 26 (only the upper one of the two plate parts is shown) which are connected by a plate part 28 extending transversely to these plate parts and a force transmitting arm 20 which can hinge about the pivot 24. Through the plate part 28, an operating screw 27 has been screwed, the screw end of which is in contact with the force transmitting arm 20. One end of the force transmitting arm 20 is in contact with the brake block 17. When the operating screw 27 is tightened, the brake block 17 blocks the first hinge 21, and when the operating screw 27 is loosened, the brake block 17 releases the first hinge. In the released condition, a user can hinge the second frame part 12 with respect to the first frame part 11 by moving the second frame part with the aid of the handle 34 shown. It is noted that instead of the operating mechanism shown, other operating mechanisms can be utilized.

Owing to the above-mentioned slideability of the sliding part 5 in the table engaging portion 7, the instrument 1 is adjustable in the sense that in the table fastening condition, different distances can be set between the table engaging portion 7 and the first axis of rotation 31 of the first hinge 21. In the example shown, this adjustability is a continuously variable adjustability.

The instrument 1 comprises aligning means for aligning in the table fastening condition a position of the first axis of rotation 31 depending on a person of a position thus lying on the operating table. In the example shown, the aligning means are designed to project a light beam extending in line with the first axis of rotation 31 on a person lying on his back on the lying surface of the operating table. In the example, the aligning means comprise a light channel 6 in the instrument, extending in line with the first axis of rotation, see for instance FIG. 4. In the example, the light channel shown extends through the first hinge 21, and through an element 8 projecting relative to the first hinge 21. In the example, the light source of the light beam indicated with reference numeral 9 is formed in that a user shines a flashlight 10 into the light channel 6 in the direction of the person lying on the operating table.

As already mentioned in the introduction, upon setting of the instrument, the position of the first axis of rotation 31 is preferably aligned such that the first axis of rotation 31 substantially coincides with the transversal axis of rotation of the hip joint of the person lying on the operating table. When aligning with the aid of the light beam 9 it is, in practice, simple to determine on the basis of the light spot projected by the light beam 9 on the person whether such a position of the first axis of rotation 31 is obtained. It is noted that upon this aligning of the first axis of rotation 31, while operating the operating screw 15, also, the table engaging portion 7 can be slid along the longitudinal side 4 of the operating table 2.

Figure 6:
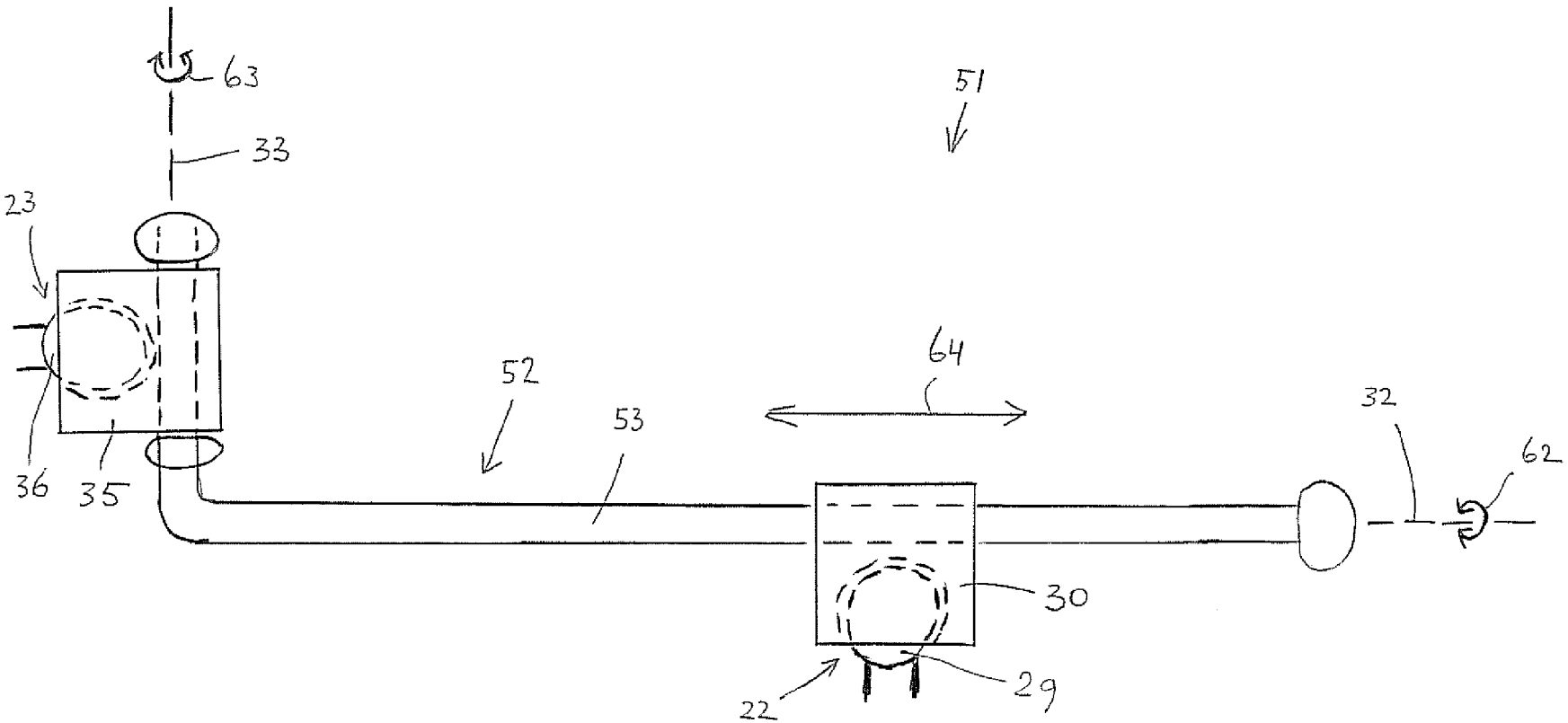
FIG. 6 shows another part of the example of FIG. 1 in top plan view.

The adjustable support means 51 are fastened to the second frame part 12 by means of a second ball joint 22. The second ball joint 22 comprises a ball 29 fixedly secured to the second frame part 12 (see in particular FIG. 3) which cooperates with a socket of the second adjusting element 30 (see in particular FIGS. 5 and 6). The adjustable support means 51 comprise an adjusting part 52 which adjusting part comprises a longitudinal part 53 which is adjustable in that the elongated part is slideable in its longitudinal direction 32 relative to the second ball joint 22, and is rotatable about a second axis of rotation 32 formed by its longitudinal direction. In FIG. 6, the latter slideability is indicated with a double arrow 64 and the latter rotatability with a double arrow 62. To that end, the second adjusting element 30 comprises a passage for receiving the elongated part 53 therein in a slideable/rotatable manner, see for instance FIG. 5. The second adjusting element 30 comprises an operating screw 35 (see FIG. 5) for simultaneously blocking or releasing the ball hinge movements and the sliding and rotating movements of the elongated part 53. Adjusting elements having such functionalities are commercially available.

In the example shown, the adjustable support means 51 comprise lower leg engaging means (in FIGS. 1, 2 and 7 indicated with reference numeral 54) which are designed for retaining, in the lower leg engaging condition, a lower leg of a person lying on his back on the operating table 2, and wherein the lower leg engaging means are fastened to the adjusting part 52 by means of a third ball hinge 23.

Figure 7:
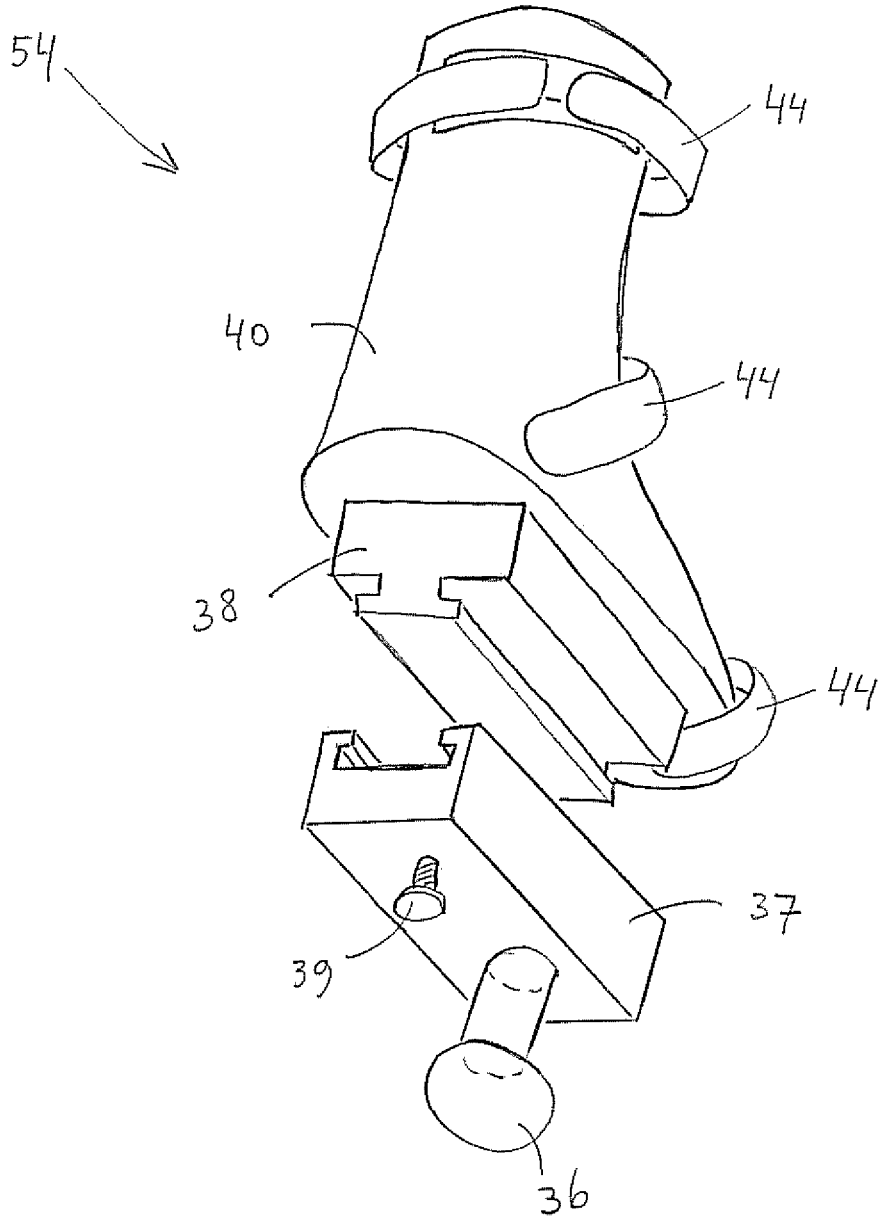
FIG. 7 shows, in perspective, an example of lower leg engaging means utilized in a leg support instrument according to the invention.

With reference to in particular FIG. 7, the lower leg engaging means 54 comprise a foot support part 40, manufactured from, for instance, plastic, in which the foot and the lower portion of the lower leg of a person can be placed and be retained by, for instance, Velcro tape 44. For the comfort of the person, the foot support part 40 can be provided at its inside with soft lining materials. At the bottom of the foot support part 40, a first fastening element 38 is fixedly connected to the foot support part 40. The first fastening element 38 is designed to be detachably retained, through a cooperating design by a second fastening element 37. In the example shown, the first fastening element 38 and the second fastening element 37 can slide into each other. In slid-together condition, the mutual slideability of the fastening elements 38 and 37 can be blocked and released through operation of an operating screw 39 in the second fastening element 37.

Preferably, with a leg support instrument, a collection of different foot support parts 40 with mutually different dimensions is provided, each fastened to such a first fastening element 38, and each intended for persons of different sizes. Therefore, a leg support instrument is thus provided with mutually exchangeable foot support parts 40. For instance, the respective FIGS. 8 and 9 show respective lower leg engaging means 154 and 254 with foot support parts that fittingly engage the lower legs of a relatively small and a relatively large person, respectively.

As mentioned, the lower leg engaging means 54 are fastened by means of a third ball hinge 23 to the adjusting part 52. The third ball joint 23 comprises a ball 36 fixedly secured to the second fastening element 37 (see FIGS. 6 and 7) which cooperates with a socket of a third adjusting element 35 which is similar to the above-described second adjusting element 30. In the example, the third ball joint 23 is adjustable in that the third ball joint is rotatable about a third axis of rotation 33 (see FIG. 6) which third axis of rotation has at least one component transverse to the longitudinal direction 32 of the elongated part 53. In the example, this is realized in that the adjusting part 52 has another elongated portion curved away from its elongated part 53 and which extends through a passage in the third adjusting element 35. The rotatability of the third ball joint about the third axis of rotation 33 is indicated in FIG. 6 with a double arrow 63.

FIGS. 8 and 9 illustrate one example of the many adjusting possibilities of the instrument 1 and the similar instrument 101 cooperating therewith. These Figures show in particular the possibilities of the second ball joint 22 and the third ball joint 23, the slideability of the elongated part 53 with respect to the second ball joint 22 and the exchangeability of the foot support parts. For the relatively small person 42 shown in FIG. 8, the third ball joint 23 is located, with respect to the second ball joint 22, on the side proximal to the operating table 2, while, for the relatively large person shown, in FIG. 9, the third ball joint 23 is located, with respect to the second ball joint 22, on the side remote from the operating table 2.

It is noted that the above-mentioned examples of embodiments do not delimit the invention and that within the range of the accompanying claims, various alternatives are possible. For instance, the first frame part and the second frame part can have various other forms and sizes. The different (ball) joints and hinging elements too can be designed in different manners. For instance, the ball and the socket of a ball joint may be exchanged.

It is further possible to provide the leg support instrument with additional hinge means which are designed to rotate, in the table fastening condition, respective parts of the leg support instrument relative to each other about an additional axis of rotation which is perpendicular, in the table fastening condition, to the lying surface or at least has one component perpendicular to the lying surface, so that different mutual rotational positions about the additional axis of rotation can be set and fixed. The additional axis of rotation mentioned can for instance be situated in the proximity of the first frame part 11 and/or in the proximity of the first hinge 21. It is also possible, optionally in combination with the additional hinge means mentioned, to design the second frame part to be telescopic. When using such a telescopic second frame part, the use of the slideable elongated part 53 can be omitted, in which case the lower leg engaging means can be connected directly or indirectly to a telescopic part of the telescopic second frame part, for instance with the aid of a suitable ball joint connection. Use of such additional hinge means and/or such telescopic means promote the ease of use of the leg support instrument.

However, other variants or modifications are also possible. These and similar alternatives are understood to fall within the framework of the invention as defined in the enclosed claims.

The invention claimed is:

1. A leg support instrument designed to be fastened, in a table fastening condition, to a longitudinal side of an operating table, which operating table is provided with a lying surface having a lying surface longitudinal direction (L), comprising:

a first frame part provided with fastening means having a table engaging portion for engaging, in the table fastening condition, the longitudinal side of the operating table in a fastening manner;

a second frame part having adjustable support means fastened thereto for supporting, in the table fastening condition, in a lower leg engaging condition, a lower leg of a person lying on his back on the lying surface of the operating table; and a first hinge connecting the first frame part and the second frame part in a hinging manner, which first hinge has a first axis of rotation extending, in the table fastening condition, parallel to the lying surface and transverse to the lying surface longitudinal direction (L);

wherein the instrument is adjustable in the sense that in the table fastening condition, different distances can be set between the table engaging portion and the first axis of rotation of the first hinge;

characterized by aligning means for aligning, in the table fastening condition, a position of the first axis of rotation depending on a position of a person thus lying on the operating table, wherein the aligning means are designed to project a light beam extending in line with the first axis of rotation on the person thus lying on the operating table.

2. An instrument according to claim 1, wherein the adjustable support means are fastened to the second frame part by means of a second ball joint, and wherein the adjustable support means comprise an adjusting part which adjusting part comprises an elongated part which is adjustable in that the elongated part is slideable in its longitudinal direction relative to the second ball joint, and is rotatable about a second axis of rotation formed by its longitudinal direction.

3. An instrument according to claim 2, wherein the adjustable support means comprise lower leg engaging means which are designed for retaining, in the lower leg engaging condition, a lower leg of a person lying on the operating table, and wherein the lower leg engaging means are fastened to the adjusting part by means of a third ball joint.

4. An instrument according to claim 3, wherein the third ball joint is adjustable in that the third ball joint is rotatable about a third axis of rotation which third axis of rotation has at least one component that is transverse to the longitudinal direction of the elongated part.

5. An assembly of two separate instruments according to claim 1, wherein one instrument is designed to be fastened, in the table fastening condition, to one longitudinal side of the operating table for supporting one lower leg of a person thus lying on the operating table and the other instrument is designed, in the table fastening condition, to be fastened to the other longitudinal side, opposite with respect to said one longitudinal side, of the operating table for supporting the other lower leg of said person.

6. A method for supporting, with the aid of at least one instrument according to claim 1, in said table fastening condition, at least one lower leg of a person thus lying on the operating table, wherein the distance between the table engaging portion and the first axis of rotation of the first hinge of the at least one instrument is set such that in the table fastening condition, a position of the first axis of rotation is aligned depending on a position of a person thus lying on the operating table, wherein the said aligning is carried out by projecting a light beam extending in line with the first axis of rotation on the person lying on the operating table.

7. A method according to claim 6, wherein the position of the first axis of rotation is aligned such that the first axis of rotation substantially coincides with the transversal axis of rotation of the hip joint of the person lying on the operating table.

* * * * *

UNITED STATES PATENT AND TRADEMARK OFFICE

CERTIFICATE OF CORRECTION

PATENT NO. : 8,448,274 B2
APPLICATION NO. : 12/936574
DATED : May 28, 2013
INVENTOR(S) : Paulus Maria Antonius Broens It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 422 days.

Signed and Sealed this
Eighth Day of September, 2015

Michelle K. Lee

Michelle K. Lee
*Director of the United States Patent and Trademark Office*